United States Patent [19]

Cheney et al.

[11] Patent Number: 4,781,736

[45] Date of Patent: Nov. 1, 1988

[54] ELECTROSTATICALLY ENHANCED HEPA FILTER

[75] Inventors: William A. Cheney, Cincinnati; Wendell P. Spurgin, Montgomery, both of Ohio

[73] Assignee: United Air Specialists, Inc., Cincinnati, Ohio

[21] Appl. No.: 933,106

[22] Filed: Nov. 20, 1986

[51] Int. Cl.[4] ..... B03C 3/12; B03C 3/14

[52] U.S. Cl. ..... 55/132; 55/138; 55/151; 55/152

[58] Field of Search ..... 55/132, 133, 136–138, 55/151, 152

[56] References Cited

U.S. PATENT DOCUMENTS

| | | | |
|---|---|---|---|
| 2,352,651 | 7/1944 | Meston | 55/151 X |
| 2,789,657 | 4/1957 | Fields | 55/137 |
| 2,798,572 | 7/1957 | Fields | 55/137 |
| 4,266,948 | 5/1981 | Teague et al. | 55/131 X |
| 4,357,150 | 11/1982 | Masuda et al. | 55/132 X |
| 4,509,958 | 4/1985 | Masuda et al. | 55/132 |

FOREIGN PATENT DOCUMENTS

| | | | |
|---|---|---|---|
| 464192 | 4/1937 | United Kingdom | 55/138 |
| 892908 | 4/1962 | United Kingdom | 55/136 |

*Primary Examiner*—Kathleen J. Prunner
*Attorney, Agent, or Firm*—Frost & Jacobs

[57] ABSTRACT

A conventional HEPA (high efficiency particulate air) filter is provided with a ionizer at its air inlet face to enhance its efficiency. The filter comprises a non-conductive fibrous filter medium sheet formed in a zig-zag or accordian fold. Within each fold of the filter medium is there located a conductive spacer so that the accordian folds are supported and substantially evenly spaced throughout the filter. By virtue of the accordian fold of the filter medium sheet, a series of spacers, forming a first set thereof, each has one of its longitudinal edges exposed at the air inlet face of the filter and the other of its longitudinal edges covered at the air discharge face of the filter. The remaining spacers constitute a second set thereof, each having one of its longitudinal edges exposed at the air discharge face of the filter and the other of its longitudinal edges covered at the air inlet face of the filter. The spacers of the first and second sets alternate, one adjacent the other. The ionizer comprises a plurality of wire-like electrodes and grounded plate-like electrodes arranged alternately and in parallel spaced relationship in a plane perpendicular to the spacers and are positively charged by connection to a high voltage, low current source. The ionizer electrodes are located within charging range of the first set of spacers which are charged by ion flow from the corona of the ionizing electrodes. To create a field between the first set of spacers and the second set of spacers, the spacers of the second set are connected together and to ground. In another embodiment the ionizer is located remotely with respect to one or more HEPA filters and functions to charge the particulate material. A single wire-like electrode is located at each HEPA filter to charge one of its first and second sets of spacers, the other of its first and second sets of spacers being connected to ground.

8 Claims, 4 Drawing Sheets

ELECTROSTATICALLY ENHANCED HEPA FILTER

TECHNICAL FIELD

The invention relates to an electrostatically enhanced HEPA filter and more particularly to such a filter used in conjunction with an ionizer to charge particulate material entering the filter and having means to induce an electrostatic charge on alternate ones of the filter spacers, the remaining filter spacers being grounded to create a field between adjacent filter spacers to greatly enhance the efficiency of the HEPA filter.

BACKGROUND ART

HEPA (high efficiency particulate air) filters are well known in the art and are widely used in those industries, clean rooms and the like wherein the highest quality clean air is required. Most clean rooms utilize a vertical air flow system with HEPA filters arranged in a grid in the ceiling. Air is appropriately ducted to the HEPA filters above the ceiling and clean air is flooded into the area of the clean room from the HEPA filters and passes down through the floor. A Class 100 clean room is a clean room having 100 airborne particles per cubic foot of air. Class 10 (or less) clean rooms are presently being contemplated.

Some of the most stringent requirements tday are to be found in the semi-conductor industry. Until recently, the goal was to remove particles down to 0.3 micrometer in size. With the advent of greatly reduced size integrated circuits, particle sizes less than 0.1 micrometer have become of interest.

The usual HEPA filter, having the best grade filtering medium is generally characterized by a collection efficiency of about 99.97% for 0.3 micrometer particles and is further characterized by a pressure drop of 20 mm $H_2O$ at a standard air velocity of 2.5 cm/s perpendicular to the filter medium. Another type of HEPA filter provided with a different filter medium is generally characterized by a collection efficiency of 94% for 0.3 micrometer size particles and a pressure drop of 10 mm $H_2O$ at a standard air velocity. The lowest grade filter of HEPA construction is characterized by a collection efficiency of only about 30% for 0.3 micrometer size particles, and a low pressure drop of 2 mm $H_2O$ at standard air velocity. In general, conventional HEPA filters do not collect 0.1 micrometer particles at an efficiency that is satisfactory for very low particle count clean rooms.

An electrostatically augmented HEPA filter is described in U.S. Pat. No. 4,357,150. This patent teaches the combination of an electrostatically augmented HEPA filter and an ionizer located at the upstream or air inlet face thereof. The ionizer comprises alternate plates and wires in parallel spaced relationship. The wires are connected to a high d.c. voltage source. The plates are connected to ground. The ionizer section charges the particulate material entering the HEPA filter. Those spacers of the HEPA filter having an exposed longitudinal edge at the air inlet side of the HEPA filter are connected to ground. Those spacers having an exposed longitudinal edge at the air discharge face of the HEPA filter are connected to a high voltage d.c. electric power source.

It has been demonstrated that a filter device of the type taught in U.S. Pat. No. 4,357,150 is characterized by a dramatic increase in the efficiency of the HEPA filter with a simultaneous reduction in the rate of increase of pressure drop as the HEPA filter becomes dirty. This, in turn, results in an extension of the life of the HEPA filter with significant savings in material and labor to replace and test a new HEPA filter for proper edge seal and the like.

As reported by Senichi Masuda and Naoki Sugita in the paper ELECTROSTATICALLY AUGMENTED AIR FILTER FOR PRODUCING ULTRA CLEAN AIR presented at the 74th Annual Meeting of the Air Pollution Control Association, Philadelphia, Pa., June 21–26, 1981, tests were made of three electrostatically augmented air filter devices of the type taught in U.S. Pat. No. 4,357,150, utilizing filtering media of the 99.97%, 94% and 30% efficiency types. Following the teachings of U.S. Pat. No. 4,357,150, the electrostatically enhanced HEPA filter utilizing the 99.97% medium demonstrated a collection efficiency for 0.15 micrometer size particles of about 99.9998%. Utilizing the 94% medium (at a lower cost and a smaller pressure drop) a collection efficiency for 0.15 micrometer size particles as high as 99.999% was demonstrated. For a 30% medium, with a very low pressure drop, a collection efficiency of 97% was obtained for 0.3 micrometer particles, which is more than adequate for many usual air cleaning purposes.

Despite its increased efficiency and reduction in pressure drop as the filter medium gets dirty, acceptance of the electrostatically augmented HEPA filter has been slow because of concern that arcing might occur between adjacent spacers. For a nominal 24×24×12 inch HEPA filter, the capacitance of the aluminum spacers would produce about 0.104 mJ of energy in an arc, which is about the minimum ignition energy for explosive gases. The possibility of a fire is another concern. Furthermore, there is a risk of holes being formed in the filter medium and particulate matter being generated during the arcing from the charged spacer through the filter medium to the adjacent grounded spacer.

Since, in such an electrostatically augmented filter device all of the spacers exposed at the air inlet face of the filter are connected together and to ground, and since all of the spacers exposed on the air discharge face of the filter are connected together and to a source of high voltage, should an arc discharge occur at a part of a certain spacer, the charges of all of the spacers move to the discharging part, not only to increase the discharge energy, but also to create a temporary drop of spacer voltage and a temporary reduction of dust collecting efficiency. In addition, as indicated above, the filter medium may become damaged or perforated. Furthermore, when the ambient humidity is high, the non-conductive characteristic of the filter medium is weakened, reducing dust collecting efficiency.

These problems are addressed in U.S. Pat. No. 4,509,958. Among other things, this reference teaches the connection together of those spacers exposed at the air inlet face of the filter and the connection together of those spacers exposed at the air discharge face of the filter by various embodiments utilizing an electroconductive material having an electric resistance for preventing movement of charges on the spacers so that, should arcing occur at a certain spacer, the amount of discharge is restricted and charges of the other spacers are greatly restricted from moving to the discharge point, minimizing the discharge energy. This reference further contemplates the incorporation of insulating material between the filter medium and the spacers exposed at the air inlet face of the filter and/or between the filter medium and the spacers exposed at the air discharge face of the filter, to minimize arcing and the effects of high humidity.

The solutions to the above outlined problems, as presented in the above noted U.S. Pat. No. 4,509,958 require major modification of the conventional HEPA construction. The present invention is based upon the discovery that the above noted problems can be overcome, while still achieving the dramatic improvements demonstrated by an electrostatically augmented HEPA filter by minimum modification to the HEPA filter construction. The teachings of the present invention assure that, should an arc occur, the energy thereof is limited to the extent that damage cannot result. Furthermore, the modifications to a conventional HEPA filter, according to the present invention, are such that retrofitting of existing HEPA filters can readily be accomplished.

DISCLOSURE OF THE INVENTION

According to the invention, a conventional HEPA filter is electrostatically enhanced to markedly increase its efficiency through the provision of an ionizer at its air inlet face. The HEPA filter comprises a non-conductive fibrous filter medium sheet formed in a zig-zag or accordian fold. A conductive spacer is located within each fold of the filter medium so that the accordian folds are substantially evenly spaced and supported throughout the filter. This filter structure is located within a frame to which the structure is appropriately sealed to preclude passage of dust laden air between the filter structure and its frame.

By virtue of the accordian fold of the filter medium sheet, the spacers are divided into alternating first and second sets. The spacers of the first set each has one of its longitudinal edges exposed at the air inlet face of the filter and the other of its longitudinal edges covered by the filter medium sheet at the air discharge face of the filter. The spacers of the second set each has one of its longitudinal edges exposed at the air discharge face of the filter and the other of its longitudinal edges covered at the air inlet face of the filter.

The ionizer comprises a plurality of alternate wire-like electrodes and plates arranged in parallel spaced relationship. The wire-like electrodes are poitively charged by connection to a high voltage, low current d.c. source. The plates are connected to ground. The ionizer electrodes are located within charging range of the spacers of the first set, which spacers become charged by ion flow from the corona of the ionizing electrodes. To create a field between the first set of spacers and the second set of spacers, the spacers of the second set are connected together and to ground.

In another embodiment of the present invention an ionizer is provided with its air discharge side connected by appropriate duct work to the air inlet side of one or more HEPA filters. The ionizer is located remote from the one or more HEPA filters. Each of the one or more HEPA filters can be identical to the one just described above with the exception that the air inlet side of the HEPA filter is provided with a single charging wire-like electrode, connected to a high voltage, low current d.c. source, and located within charging range of the spacers of the first set which become charged by ion flow from corona of the charging wire-like electrode. The second set of spacers are again connected to ground.

Alternatively, the single wire-like electrode can be located at the air discharge side of the HEPA filter within charging range of the second set of spacers which become charged thereby. In this instance the first set of spacers, rather than the second set, are connected to ground.

DETAILED DESCRIPTION OF THE INVENTION

The HEPA filter utilized in the practice of the present invention is substantially conventional, except for those modifications to be enumerated hereinafter. The HEPA filter is illustrated in FIGS. 1 and 2, and is generally indicated at 1.

The filter 1 comprises a frame, generally indicated at 2. The frame may be made of any appropriate non-conductive material, such as wood, pressboard, molded plastic or the like. For purposes of an exemplary showing, the frame is illustrated as comprising four side members *2a–2d*.

Within the confines of the frame 2, there is located a non-conductive, fibrous filter medium sheet 3 of fiberglass or other appropriate material known in the art. As can most clearly be seen in FIG. 2, the filter medium sheet 3 is folded in a zig-zag or accordian fold with one of its ends lying along frame side member *2c*. It will be appreciated that the other of its ends will similarly lie along frame side member *2a*. The filter medium sheet is of such width as to extend from frame side *2b* to frame side *2d*.

Figure 1:
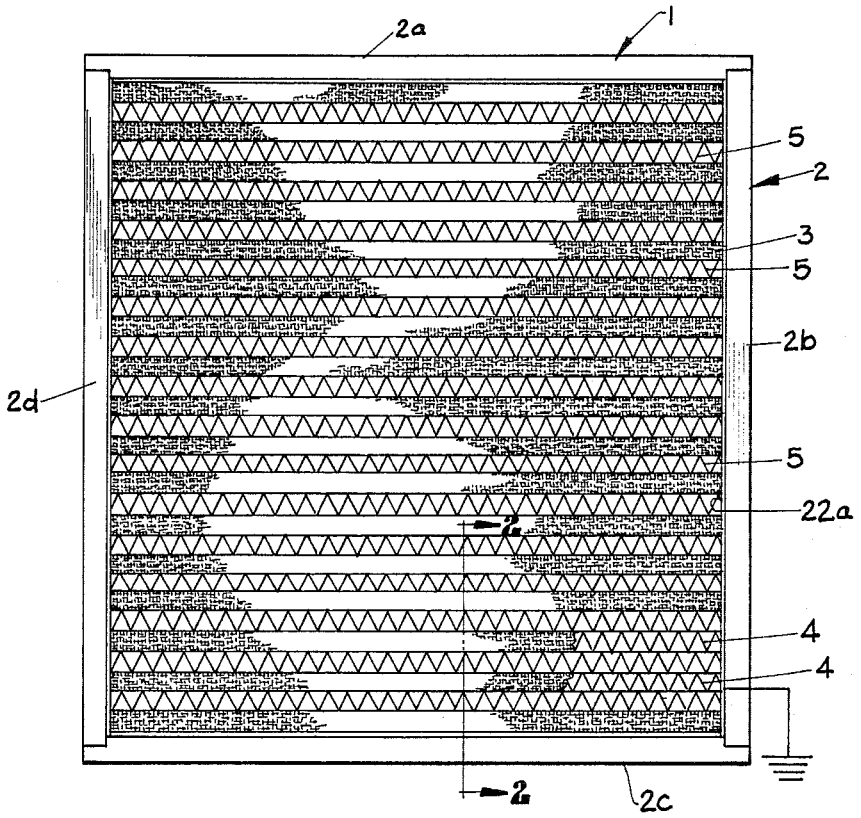
FIG. 1 is an elevational view of the electrostatically enhanced HEPA filter of the present invention, illustrating the air discharge face thereof.
Figure 2:
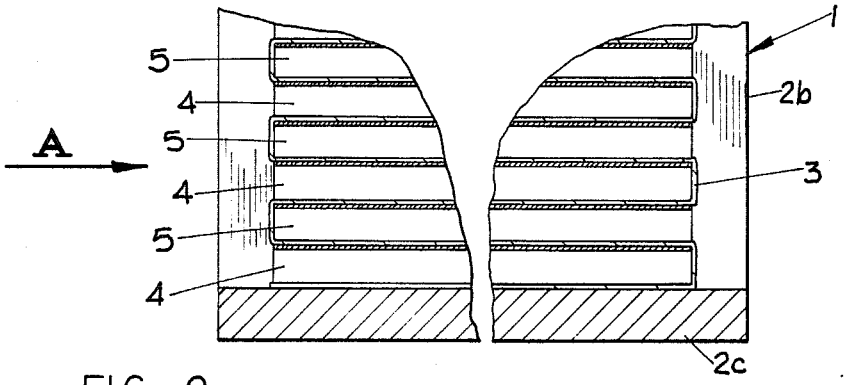
FIG. 2 is a fragmentary cross sectional view taken along section line 2—2 of FIG. 1.

As can be seen from both FIGS. 1 and 2, the folds of the filter medium sheet 3 are substantially evenly spaced from each other and are held substantially parallel to each other by a plurality of spacer elements 4 and 5.

Spacer elements 4 and 5 are identical and are made of electrically conductive material. Such spacers most frequently encountered in the industry are made of corrugated metallic foil such as aluminum foil and the spacers 4 and 5 are so illustrated in FIGS. 1 and 2. The spacers 4 and 5 (as is true of filter medium sheet 3) extend from frame side member *2b* to frame side member *2d* with the corrugations extending in the direction of flow of the dust laden air. This flow direction is indicated by arrow A in FIG. 2.

Although the spacers 4 and the spacers 5 are identical, they have been designated by different index numerals for the following reason. It will be noted that by virtue of the accordian fold of the filter medium sheet 3, that longitudinal edge of each spacer 4 at the air inlet face of filter 1 is exposed, while that longitudinal edge of each spacer 4 at the air discharge face of filter 1 is covered by the filter medium sheet 3. In the same fashion, that longitudinal edge of each spacer 5 at the air inlet face of filter 1 is covered by the filter medium sheet 3, while that longitudinal edge of each spacer 5 at the air discharge face of filter 1 is exposed. Thus, the accordian fold of the filter medium sheet divides the identical spacers into two sets or groups designated, respectively 4 and 5.

The spacers 4 and 5 support and maintain the folds of the filter medium sheet 3. The structure comprising the spacers 4 and 5 and the filter medium sheet 3 is sealed about its edges in air-tight fashion to the frame 2 to preclude passage of dust laden air between the structure and its frame. This sealing is accomplished through the use of a non-conductive epoxy material or the like (not shown), as is well known in the art.

Figure 3:
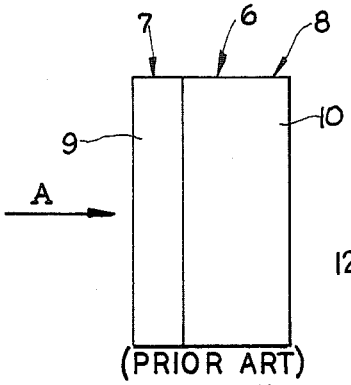
(PRIOR ART) FIG. 3
FIG. 3 is a side elevational view of the prior art filter device of U.S. Pat. No. 4,357,150.

FIG. 3 is a side elevational view of the filter device of the above noted U.S. Pat. No. 4,357,150. The filter device, generally indicated at 6, comprises an ionizer generally indicated at 7 and a HEPA filter generally indicated at 8. While the ionizer 7 is shown as having a frame 9 and the HEPA filter 8 is shown as having a separate frame 10, it will be understood that the frames 9 and 10 could constitute an integral, one-piece framework. In FIG. 3, the direction of travel of the dust laden air is again indicated by arrow A.

Figure 4:
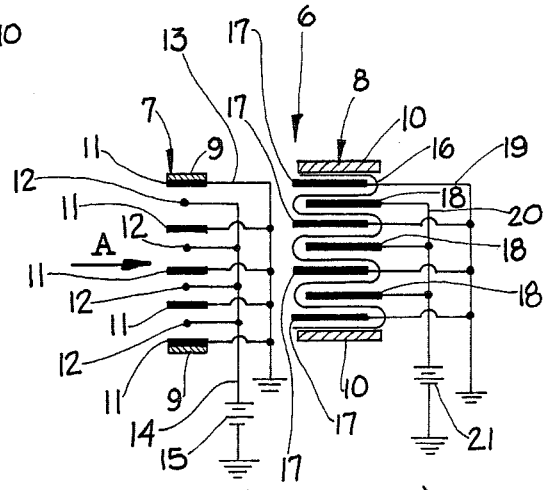
(PRIOR ART) FIG. 4
FIG. 4 is a simplified, diagrammatic representation of the prior art filter device of U.S. Pat. No. 4,357,150.

Reference is now made to FIG. 4 which constitutes a simplified diagrammatic representation of the filter device of U.S. Pat. No. 4,357,150. In FIGS. 3 and 4, like parts have been given like index numerals.

Turning first to ionizer 7, it will be noted that located within frame 9 there is a series of alternating plate electrodes 11 and wire-like charging electrodes 12. It will be noted that the planes of the plate-like electrodes 11 are parallel to the direction of air flow, as indicated by arrow A. The plate-like electrodes 11 and the wire-like electrodes 12 are in parallel spaced relationship. It will be noted that the plate-like electrodes 11 are connected, as at 13, to ground. The wire-like electrodes 12 are connected, as at 14, to a high d.c. voltage source 15.

The structure of the HEPA filter 8, within frame 10, is substantially as described with respect to FIGS. 1 and 2. To this end, an accordian folded filter medium sheet 16 is provided, equivalent to filter medium sheet 3. Alternate sets of spacers 17 and 18 are shown. The spacers 17 are equivalent to spacers 4 and the spacers 18 are equivalent to spacers 5 of FIGS. 1 and 2. It will be noted that all of spacers 17 are connected together and to ground as at 19. All of spacers 18 are connected together, as at 20, and to a high d.c. voltage source 21. It will be appreciated with respect to FIG. 4 that the number of plate-like electrodes 11 and wire-like electrodes 12 of ionizer 7, as well as the number of spacers 17 and 18 of HEPA filter 8 have been reduced for purposes of simplicity and clarity.

In operation, the voltage sources 15 and 21 apply different dc voltages to the charging electrodes 12 of ionizer 7 and the spacers 18 of HEPA filter 8, respectively. The charging electrodes 12 and spacers 18 are preferably given a plus charge to reduce the formation of ozone. Dust laden air or gas enters the filter device in the direction of arrow A. The dust particles are electrically charged by corona discharge as the air or gas passes through ionizer 7. The air or gas carrying the charged particles thereafter enter the HEPA filter 8 and most of the charged particles are attracted to and deposited upon the spacers 17. An electrostatic field exists between adjacent spacers 18 and 17 and passes through filter medium sheet 16. This causes the remainder of the particles in the air or gas to be deposited within the filter medium sheet 16 in a porous fashion. As a result of this electrostatic augmentation of HEPA filter 8, its efficiency is dramatically increased and its pressure drop is significantly reduced, as described above.

It will be apparent from the diagrammatic representation of FIG. 4 that, should an arc occur between an adjacent pair of spacers 18 and 17, the charge on all of the spacers 18 will be drained to the position of the arc since the spacers 18 are connected together. This raises the possibility of ignition of the incoming gas, fire, or damage or perforation of the filter medium sheet 16, and the creation of additional particulate material as a result thereof. The above noted U.S. Pat. No. 4,509,958 would minimize these problems through major modifications to the HEPA filter 8.

Figure 5:
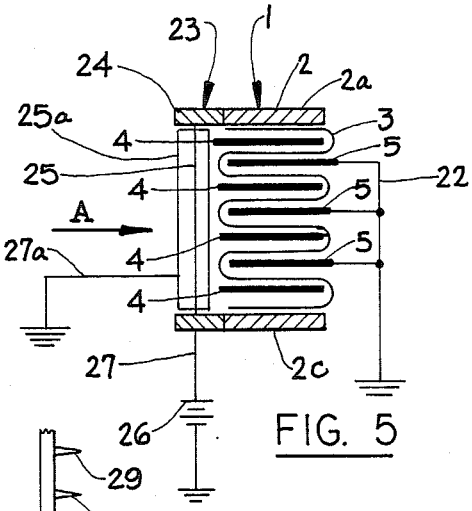
FIG. 5 is a simplified, diagrammatic representation of the electrostatically enhanced filter of the present invention.

FIG. 5 illustrates the electrostatically enhanced HEPA filter of the present invention. Like parts have been given like index numerals with respect to FIGS. 1, 2 and 5. In FIG. 5, the HEPA filter 1 of FIGS. 1 and 2 is shown, together with its frame 2, its filter medium sheet 3, its first set of spacers 4 and its second set of spacers 5. It will be noted that the first set of spacers 4 (i.e., those spacers having a longitudinal edge exposed at th air inlet side of the filter) are not connected together or to ground. The second set of spacers 5 (i.e., those spacers having a longitudinal edge exposed at the air discharge face of the filter) are connected together and to ground as at 22. The connecting of the spacers 5 of the second set thereof to ground can be accomplished in any appropriate manner which will not create an obstruction to the flow of air or gas through the HEPA filter in the direction of arrow A. To this end, a ground wire may be attached to each of spacers 5. Each of spacers 5 could be connected to a terminal for grounding by conductive paint which contacts the edge of each of the spacers 5. Such a layer of paint is shown (of greatly exaggerated thickness) at **22*a* in FIG. 1**. A layer of conductive foam could be used to serve the same purpose.

The only other modification to the HEPA filter 1 of the present invention is the provision of an ionizer 23 at its air inlet face. In FIG. 5, the ionizer 23 is illustrated as comprising a separate frame 24. It will be understood that the frame 24 could constitute an integral, one-piece part of the HEPA filter frame 2. Mounted within the confines of ionizer frame 24 there is a plurality of wire-like electrodes, one of which is shown in FIG. 5 at 25 and a plurality of plates, one of which is shown at **25*a*. The wire-like electrodes 25 and plates 25*a* are equivalent to the wires 12 and plates 11 of ionizer 7 of FIG. 4. The wire-like electrodes 25 and plates 25*a* are arranged alternately and in parallel spaced relationship and lie within a plane parallel to the air inlet face of HEPA filter 1. Wire-like electrodes 25 are connected to a high voltage, low current d.c. source 26, as at 27. The plates 25*a* are connected to ground as at 27*a***.

The single wire-like ionizer electrode 25 and plate **25*a* of FIG. 5 is shown extending vertically in that figure and perpendicular to the planes of spacers 4 and 5. This is the preferred orientation of the ionizer wire-like electrodes 25 and plates 25***a* with respect to the HEPA filter spacers 4 and 5. It would be possible, however, to arrange the wire-like electrodes 25 horizontally, as viewed in FIG. 5, and parallel to spacers 4 and 5.

The wire-like electrodes 25 of ionizer 23 are so located as to be within charging range of the aluminum spacers 4 of the first set thereof. It will be noted that the aluminum spacers 4 have a longitudinal edge exposed to the electrodes 25, while the spacers 5 are insulated therefrom by the non-conductive filter medium sheet. Any current leakage to the grounded spacers is dissipated to ground. Thus, spacers 4 become charged by ion flow from the corona on the ionizing electrodes 25. A field is created between adjacent aluminum spacers 4 and 5 and through the filter medium sheet 3 by the grounding as at 22 of spacers 5.

The number and spacing of the ionizer wire-like electrodes 25 can readily be ascertained by one skilled in the art. The wire-like electrode and plate electrode spacing and voltage are interrelated and their design is such as to produce near saturation charging of the particulate material, as is well known. For example, excellent results were achieved utilizing an 18×18×12 inch HEPA filter 1 provided with an ionizer 23 having seven evenly spaced wire-like electrodes 25, interleaved with eight plate electrodes 25*a*, and arranged in the manner illustrated in FIG. 5.

The construction of the electrostatically enhanced HEPA filter of FIG. 5 having been set forth in detail, its operation will next be described. In an exemplary test, the wire-like electrodes 25 of ionizer 23, being connected as at 27 to a high d.c. voltage source of about 12 kv were preferably positively charged to minimize the formation of ozone. The wire-like electrodes 25 electrically charged by corona discharge the dust particles in the air or gas passing through the filter structure in the direction of arrow A. At the same time, by virtue of the proximity of the wire-like electrodes 25 to the first set of spacers 4, the spacers 4 had a charge built up thereon by ion flow from the corona of the electrodes 25. A field was formed between adjacent spacers 4 and 5, by virtue of the spacers 5 being connected to ground as at 22. These fields pass through the filter medium sheet 3, greatly enhancing its filtering efficiency. The dust particles of the air or gas passing through the filter structure in the direction of arrow A are collected in the filter medium sheet in a loose or porous fashion such that the filtering efficiency is greatly enhanced and the pressure drop through the filter medium sheet is reduced.

It will be immediately apparent from FIG. 5 that the modifications made to HEPA filter 1 are minimal. The ionizer 23 is added to its air inlet face and that set of spacers 5 are grounded at its air discharge face. These modifications are of such nature that retrofitting of existing HEPA filters is quite feasible. As a consequence, a major advantage of the present invention is the simplicity of the HEPA filter modification. Another advantage is that the energy which can be drawn from any short circuit in the HEPA filter is limited to that energy which can be stored by the capacitance between the two aluminum spacers 4 and 5 at which arcing occurs. Thus, the capacitance of these two adjacent spacers 4 and 5 is the only source of power for an arc. This reduces by about 97% the capacitance available as an energy source for an arc from a nominal 24×24×12 inch HEPA filter and removes the power supply as a direct source of energy in the HEPA filter. If one high voltage power supply is used per HEPA filter, the energy in the arc would be reduced by at least 98%. If more than one HEPA filter is tied to a single power supply, the energy reduction in an arc would be even greater. The energy reduction is so great that there is no longer enough energy to create any damage to the filter medium sheet 3.

Yet another benefit of the present invention lies in the fact that in the event of a continuing short between a pair of adjacent spacers 4 and 5, the electrostatic enhancement influence is lost only between those two spacers, and not across the entire HEPA filter, or banks of filters tied to one power supply. Furthermore, the arc energy is so low that a continuing short circuit presents no fire hazard that might otherwise exist.

Figure 6:
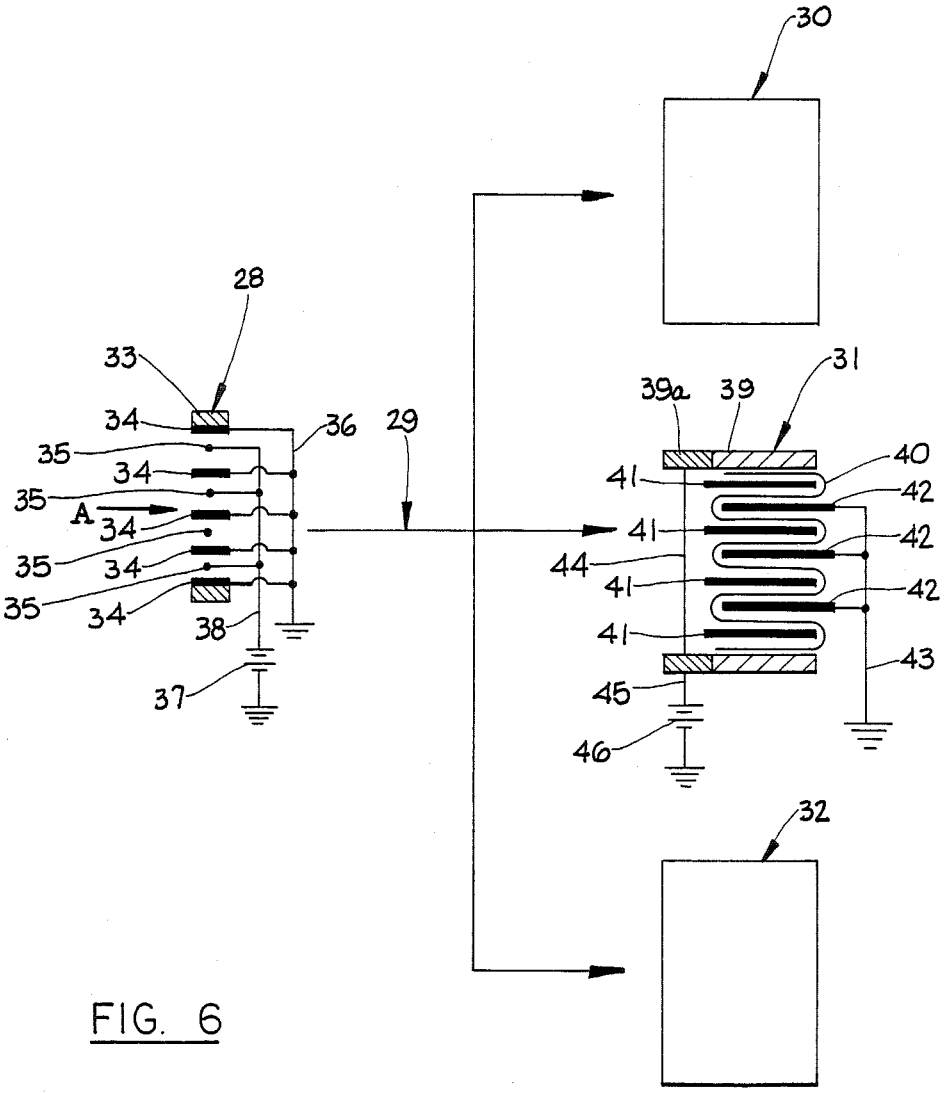
FIGS. 6 and 7 are simplified, diagrammatic representations of additional embodiments of the present invention.

Under some circumstances, it is advantageous to separate the particulate charging function from the HEPA filter spacer charging function. To this end, a second embodiment of the present invention is illustrated in FIG. 6. In FIG. 6, an ionizer, generally indicated at 28 is located in a trunk duct, generally indicated at 29. The trunk duct 29 may lead to one or more HEPA filters. For purposes of an exemplary showing only, the duct 29 is diagrammatically illustrated as leading to three HEPA filters, generally indicated at 30, 31 and 32. The number of HEPA filters does not constitute a limitation. The important fact is that the ionizer 28 is located remotely with respect to HEPA filters 30, 31 and 32.

The ionizer 28 is substantially identical to ionizer 7 of FIG. 4 or ionizer 23 of FIG. 5. Ionizer 28 comprises a frame 33 in which are located a plurality of plate electrodes 34 and wire-like electrodes 35. The plate electrodes 34 and wire-like electrodes 35 are arranged alternately in parallel spaced relationship. Again, plate electrodes 34 are connected to ground as at 36. The wire-like electrodes 35 are connected to a d.c. high voltage, low current source 37, as at 38. Again, the direction of the air to be treated is indicated by arrow A.

HEPA filters 30, 31 and 32 are identical. For purposes of explanation, HEPA filter 31 has been illustrated in a simplified fashion in cross section. It will be understood that a description of HEPA filter 31 can also serve as a description of HEPA filters 30 and 32.

HEPA filter 31 is in most respects identical to HEPA filter 1 of FIGS. 1, 2 and 5. To this end, HEPA filter 31 comprises a frame 39, a non-conductive, fibrous filter media sheet 40 folded in zig-zag or accordian fashion, a first set of spacers 41 and a second set of spacers 42. The second set of spacers, having a longitudinal edge exposed at the discharge side of HEPA filter 31, are connected together and to ground, as at 43. The first set of spacers, having a longitudinal edge exposed at the air inlet side of HEPA filter 31, are not connected together.

HEPA filter 31 differs from HEPA filter 1 of FIG. 5 only in that instead of being provided with an ionizer 23, the HEPA filter 31 is provided with a single ionizing wire-like electrode 44 connected as at 45 to a d.c. high voltage, low current source 46. Wire-like electrode 44 can be mounted in frame 39, or in its own frame 39*a*, as shown.

The single corona-producing, wire-like electrode 44 is used to charge the HEPA filter spacers 41 of the first set. The single wire-like electrode 44 is arranged parallel to the air inlet face of HEPA filter 31, but is perpendicular to the planes of spacers 41 so that ions will charge the alternate spacers 41 essentially equally. Since the spacers 42 of the second set are connected as at 43 to ground, fields are created between adjacent spacers 41 and 42. In this arrangement, HEPA filter 31, as well as HEPA filters 30 and 32 are electrostatically enhanced and function in the same manner as described with respect to FIG. 5.

The embodiment of FIG. 6 has all of the advantages set forth with respect to the emoodiment of FIG. 5. In addition, it is particularly suited for application in clean rooms, where more than one HEPA filter is used. The air velocity limit for effective particulate charging in an ionizer is much higher than the air velocity at the face of a HEPA filter. Thus, a single ionizer 28 can serve a series of HEPA filters. This reduces the cost of installation, simplifies installation, and improves service convenience since it is not necessary to provide an ionizer and a power source therefor for each of the HEPA filters.

It is to be noted that ionizer 28 is illustrated in FIG. 6 in the same orientation as ionizer 7 of FIG. 4. This was done simply to show that, since ionizer 28 is located remote from HEPA filters 30, 31 and 32, the orientation of plate electrodes 34 and wire-like electrodes 35 with respect to the HEPA filter spacers is no longer of importance. This is true, of course, because the remotely located ionizer 28 serves only a particle charging function, and not a spacer charging function, which is now performed by the single wire-like electrode 44.

Figure 7:
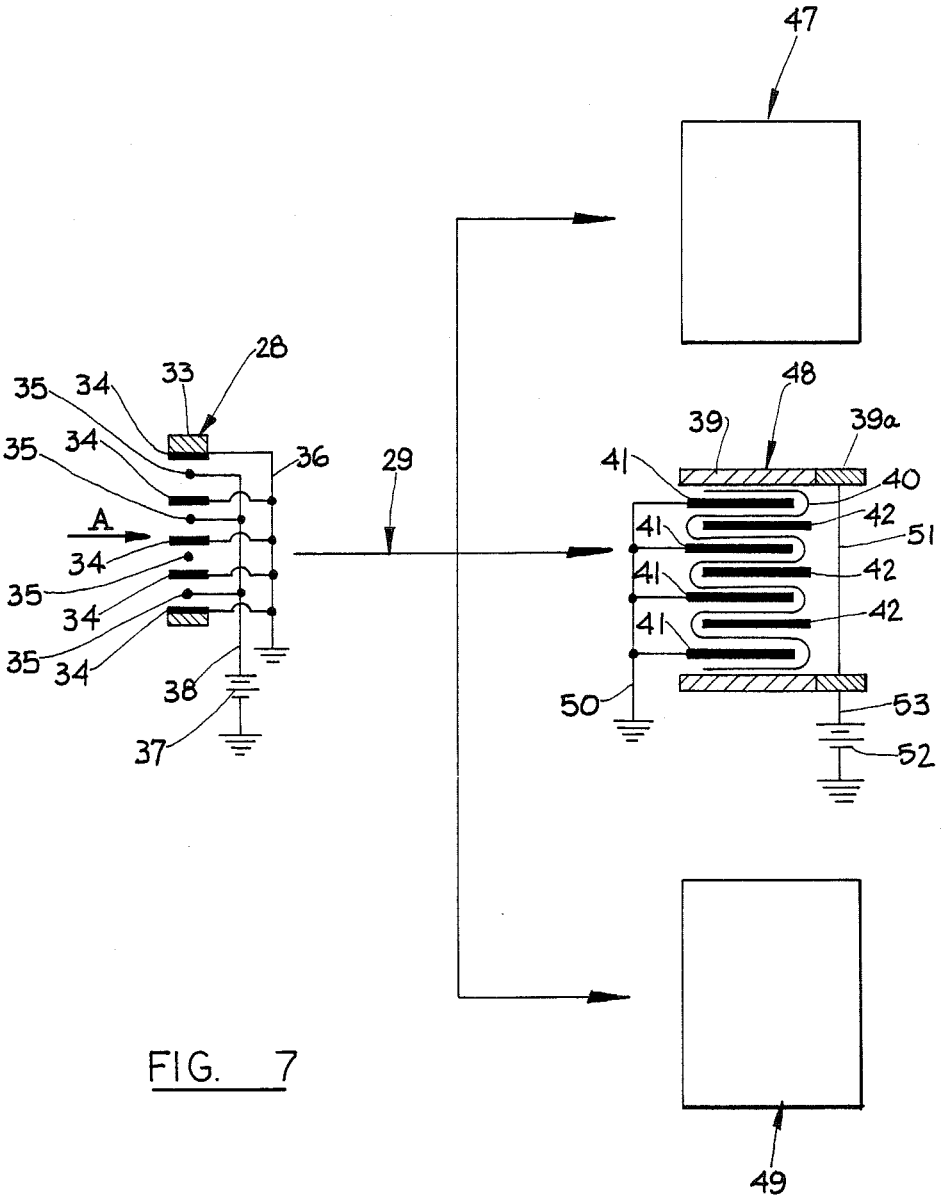

A third embodiment of the present invention is illustrated in FIG. 7. In this embodiment, the ionizer and duct work are identical to those described with respect to FIG. 6, and like parts have been given like index numerals. Again, the ionizer 28 serves only a particle charging function and is located remotely from one or more HEPA filters. As in the case of FIG. 6, for purposes of an exemplary showing, ionizer 28 in FIG. 7 is illustrated as serving three identical HEPA filters 47, 48 and 49. Since HEPA filters 47–49 are identical, a description of HEPA filter 48 will serve as a description of HEPA filters 47 and 49, as well. The basic parts of HEPA filter 48 are identical to those of HEPA filter 31 of FIG. 6, and the like parts have been given like index numerals. To this end, HEPA filter 48 comprises a frame 39, a non-conductive, fibrous filter medium 40 formed in a zig-zag or accordian fold, together with a first set of spacers 41 and a second set of spacers 42. The only difference between the HEPA filter 48 of FIG. 7 and the HEPA filter 31 of FIG. 6 lies in the fact that the spacers first set 41 of are connected together and to ground, as at 50. A single wire-like electrode 51 is provided, similar to wire-like electrode 44 and connected to a d.c. high voltage, low current source 52, as at 53. Wire-like electrode 54 can be mounted in frame 39, or in its own frame **39*a*, as shown. In this instance, however, the single wire-like electrode 51 is located at the discharge side of HEPA filter 48 and charges spacers 42 of the second set. Since the spacers 41 of the first set are connected to ground, a field is set up between adjacent spacers 42 and 41. Under these circumstances, it will be immediately apparent that it is the second set of spacers which is charged and the first set of spacers which is connected to ground, as in the prior art HEPA filter illustrated in FIG. 4. This arrangement has the advantage that a large amount of the particulate material is collected on the first set of spacers 41, thus extending the life of the fibrous filter medium 40**.

Figure 8:
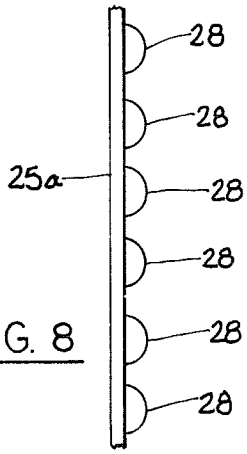
FIG. 8 is a fragmentary elevational view of a modified electrode of the ionizer of the present invention.

In the manufacture of an ionizer, such as ionizer 23 of FIG. 5, it is usual practice to use wire of a diameter of about 0.007 inch for the electrodes 25. The same is true of the single electrodes 44 of FIG. 6 and 51 of FIG. 7. Should such a small diameter electrode, spanning the full face of the HEPA filter, break, and should the broken electrode contact one or more of the spacers, sparks could result. In those environments wherein this would be undesirable, such electrodes could each be replaced by a rod of conductive material (such as aluminum, stainless steel, conductive plastics, and the like) as shown at **25*a* in FIG. 8. Attached to rod 25*a* are a plurality of small loops 28** of fine diameter wire, the loops being directed toward the face of the filter structure. Should one of the fine wire loops break, it would not be physically long enough to contact one of the filter spacers.

Figure 9:
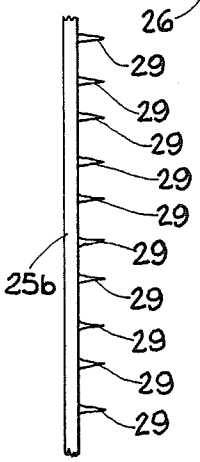
FIG. 9 is a fragmentary elevational view illustrating another embodiment of an electrode of the ionizer of the present invention.

Another alternative construction of an ionizer electrode is illustrated in FIG. 9. In this instance. the fine wire electrodes of FIGS. 5, 6 and 7 would again each be replaced by a rod **25*b* of conductive material having a plurality of sharp, needle-like metallic points 29 attached thereto and directed toward the adjacent face of the filter structure. In either embodiment of FIG. 8 or FIG. 9, the corona formed about the fine wire loops 28 or the sharp points 29** would build up a charge in the adjacent exposed filter spacers.

Modifications may be made in the invention without departing from the spirit of it.

What we claim is:

1. In combination a HEPA filter and an ionizer, said HEPA filter comprising a frame, a non-conductive fibrous filter medium within said frame folded in zig-zag fashion, a conductive spacer located in each filter medium fold supporting said folds in substantially even parallel spaced relationship throughout said filter, said spacers and filter medium being sealed along their edges to said frame, said HEPA filter having an air inlet face and an air discharge face, alternate ones of said spacers comprising a first set thereof each having a first longitudinal edge exposed at said air inlet face of said HEPA filter and a second longitudinal edge covered by said filter medium at said HEPA filter air discharge face, the remainder of said spacers comprising a second set thereof each having a first longitudinal edge exposed at said filter air discharge face and a second longitudinal edge covered by said filter medium at said filter air inlet face, said ionizer comprising a frame and a plurality of alternate wire-like electrodes and plate-like electrodes supported in parallel spaced relationship by said frame, said wire-like electrodes being connected to a d.c. high voltage low current source, said plate-like electrodes being connected to ground, said ionizer being located upstream of said HEPA filter, remote from said air inlet face of said HEPA filter, said spacers of said first set being electrically isolated one from the other, means connecting said spacers of said second set together and to ground, and means to electrostatically induce a charge on said spacers of said first set comprising at least one corona-producing wire-like electrode arranged adjacent to the air inlet face of the HEPA filter, perpendicular to the planes of the spacers of the first set and within charging range of said first set of spacers, whereby said spacers of said first set become charged by ion flow from the corona of said at least one wire-like electrode.

2. The structure claimed in claim 1 wherein said ionizer is connected to said air inlet face of said HEPA filter by duct means, said ionizer being connected to the air inlet faces of other identical HEPA filters by additional duct means.

3. The structure claimed in claim 1 wherein said at least one wire-like electrode adjacent said air inlet face of said HEPA filter comprises a rod of conductive material having attached thereto a plurality of small loops of fine-diameter wire, said loops being directed toward said air inlet face of said HEPA filter.

4. The structure claimed in claim 1 wherein said at least one wire-like electrode adjacent said air inlet face of said HEPA filter comprises a rod of conductive material having attached thereto a plurality of sharp needle-like conductive points directed toward said air inlet face of said HEPA filter.

5. In combination a HEPA and an ionizer, said HEPA filter comprising a frame, a non-conductive fibrous filter medium within said frame folded in zig-zag fashion, a conductive spacer located in each filter medium fold suporting said folds in substantially even parallel spaced relationship throughout said filter, said spacers and filter medium being sealed along their edges to said frame, said HEPA filter having an air inlet face and an air discharge face, alternate ones of said spacers comprising a first set thereof each having a first longitudinal edge exposed at said air inlet face of said HEPA filter and a second longitudinal edge covered by said filter medium at said HEPA filter air discharge face, the remainder of said spacers comprising a second set thereof each having a first longitudinal edge exposed at said filter air discharge face and a second longitudinal edge covered by said filter medium at said filter ait inlet face, said ionizer comprising a frame and a plurality of alternate wire-like electrodes and plate-like electrodes supported in parallel spaced relationship by said frame, said wire-like electrodes being connected to a d.c. high voltage low current source, said plate-like electrodes being connected to ground, said ionizer being located upstream of said HEPA filter, remote from said air inlet face of said HEPA filter, said spacers of said second set being electrically isolated one from the other, means connecting said spacers of said first set together and to ground, and means to electrostatically induce a charge on said spacers of said second set comprising at least one corona-producing wire-like electrode located adjacent to the air discharge face of the HEPA filter, perpendicular to the planes of the spacers of the second set and within charging range of said second set of spacers, whereby said sapcers of said second set become charged by ion flow from the corona of said at least one wire-like electrode.

6. The structure claimed in claim 5 wherein said ionizer is connected to said air inlet face of said HEPA filter by duct means, said ionizer being connected to the air inlet faces of other identical HEPA filters by additional duct means.

7. The structure claimed in claim 5 wherein said at least one wire-like electrode adjacent said air discharge face of said HEPA filter comprises a rod of conductive material having attached thereto a plurality of small loops of fine-diameter wire, said loops being directed toward said air discharge face of said HEPA filter.

8. The structure claimed in claim 5 wherein said at least one wire-like electrode adjacent said air discharge face of said HEPA filter comprises a rod of conductive material having attached thereto a plurality of sharp needle-like conductive points directed toward said air discharge face of said HEPA filter.

* * * * *